United States Patent [19]

Klaren

[11] 4,029,040

[45] June 14, 1977

[54] ANCHOR

[76] Inventor: Petrus Jozef Klaren, Frankenrade 3, Nieuwerkerk a/d, IJssel, Netherlands

[22] Filed: Nov. 4, 1975

[21] Appl. No.: 628,765

[30] Foreign Application Priority Data

Nov. 6, 1974 Netherlands ..... 7414485

[52] U.S. Cl. ..... 114/304

[51] Int. Cl.[2] ..... B63B 21/38

[58] Field of Search ..... 114/206 R, 207, 208 R, 114/208 A, 209

[56] References Cited

UNITED STATES PATENTS

| | | | |
|---|---|---|---|
| 2,840,029 | 6/1958 | Ogg | 114/208 R |
| 2,856,881 | 10/1958 | Cope | 114/208 R |
| 3,022,762 | 2/1962 | Hillcourt | 114/208 R |
| 3,120,830 | 2/1964 | Northrop et al. | 114/208 R |
| 3,136,278 | 6/1964 | Dare | 114/208 R |

*Primary Examiner*—Trygve M. Blix
*Assistant Examiner*—Jesus D. Sotelo
*Attorney, Agent, or Firm*—Cushman, Darby & Cushman

[57] ABSTRACT

Anchor for anchoring dredgers, off-shore drilling platforms and other special purpose vessels, comprising a shank, two flukes hinged to the shank having together a Delta shape, trim plates or head faces provided on both sides of the flukes, the width of the trim plates being less than the total width of the flukes, characterized in that the outer ends of both trim plates are connected to the outer rims of the flukes by stabilizing plates which enclose an acute angle both with the direction of the shank and with the plane of the flukes.

13 Claims, 3 Drawing Figures

ANCHOR

Figure 1:
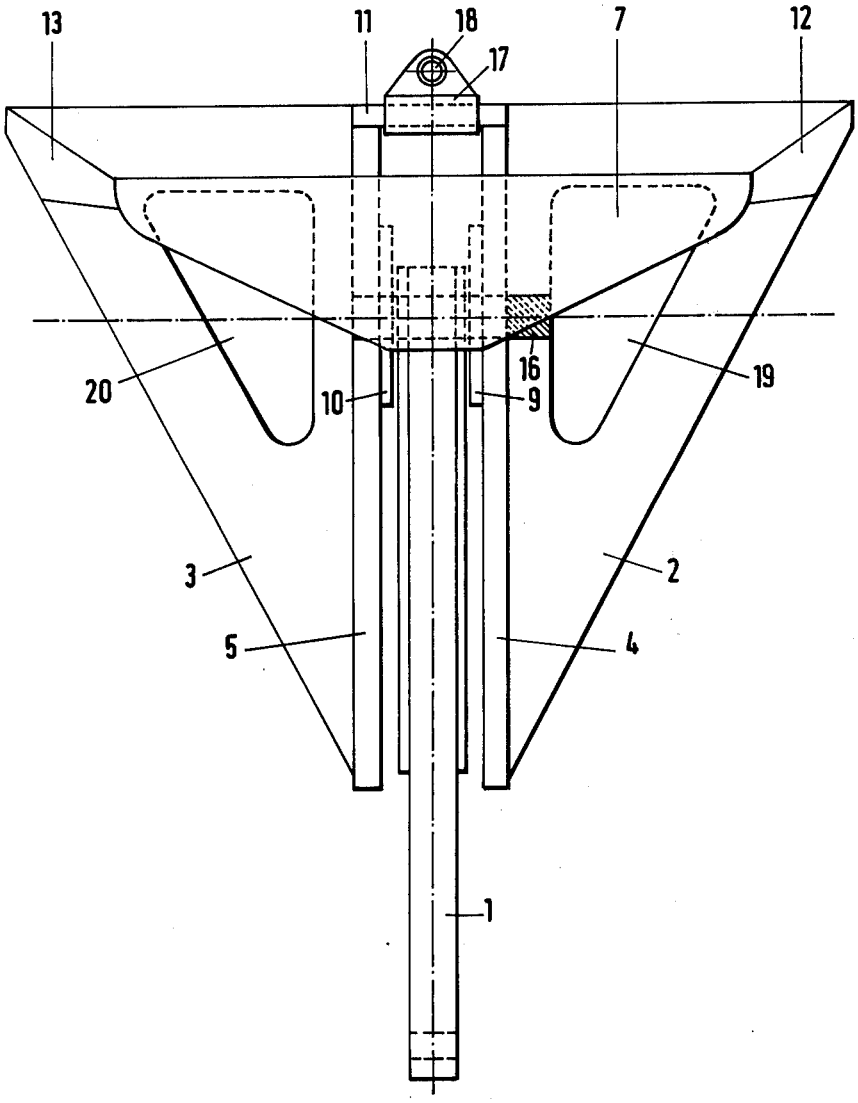

The invention relates to an anchor, in particular destined for anchoring special purpose vessels, dredgers, offshore drilling platforms etc. comprising a shank, two flukes together having a Delta shape, and trim plates or head faces provided on either side of the flukes, the width of said trim plates being less than the total width of the flukes. It is understood by width in this connection: the size of the trim plates to the direction of the shank.

Such anchor is known inter alia from U.S. Pat. No. 2.641.215 (Danforth) and is provided with a stock disposed transversely to the shank on the rear end of the fluke and serving at the same time as pivot pin for the shank.

The stock prevents the anchor from rotating around the longitudinal axis of the shank. Each anchor tends to do so because the forces acting on the flukes on either side of the longitudinal axis of the shank are unequal due to the uneveness of the anchorage ground.

The stock project considerably, thus increasing the width of the anchor; with the "Danforth" "Meon" and "G.S." types by 109–147%, with the "Stayright" and "Offdrill" types by 166–238%, with the "Stevin" type, being itself very wide already, by 42%.

That width increase is disadvantageous for using the anchors is the more apparent because these anchors are mostly employed as working anchors on floating drilling platforms, special purpose vessels, floating cranes and the like, when a tug or supply boat has to take the anchors on deck or bring the anchors out or such operations.

Care should also be taken that the projecting stock does not damage or cause a leak in its own vessel or other vessels, in particular in case of swell.

Another drawback of the projecting stock is the fact that steel wires may get caught behind it. When the anchor is dropped on the pennant wire, the floating pennant-wire - in case the anchor lies on the bottom - will then easily get stuck around the stock of the anchor. The breaking out of the anchor will then be particularly difficult and often the pennant wire breaks, entailing an expensive operation to break out the anchor.

Also when the anchor lies on deck or hangs beside a special purpose vessel or drilling rig, there will be the constant hazard that mooring cables, pull or drag cables get caught behind the transverse stocks.

It is an object of the invention to eliminate these drawbacks. To this effect the outer ends of both trim plates, according to the invention, are connected to the side edges of the flukes through stabilizing plates, which enclose an acute angle both with the direction of the shank and with the plane of the flukes.

The stabilizing plates aim at increasing the stability of the anchor. It is understood by stability the degree wherein an anchor, under all circumstances, searches or maintains its proper dig-in position. The position of the stabilizers is very important. The plates of said stabilizers should be so directed that the digging-in of the anchor is minimally impeded, while the stabilizers have their maximal effect when the anchor rests on one of the stabilizing plates, thus toppling the anchor towards its dig-in position.

In a preferred embodiment of the anchor according to the invention the stabilizer plates enclose an angle of 55° – 65° with the plane of the flukes.

Furthermore it is important that also the front sides of the stabilizers are bevelled so that they cut easily into the ground and cause as little as possible clod forming of the ground.

Many anchors, e.g. of the "Baldt" Stockless Bow-anchor type, have at the 4 corners of the head of the anchor, 4 faces that are at right angles to the flukes and at right angles to the direction of pull. These faces also called shoulders, serve for toppling over the anchor, from horizontal position, so that the tips of the flukes penetrate into the ground and the dig-in commences.

Said faces have no use for the stability. On the contrary, they produce clod forming, thus increasing the inequality of forces acting on either side of the longitudinal axis of the shank, which results in rotation and breaking out of the anchor.

Experiments on scale have established that stabilizers according to the invention have a maximum yield when their plates enclose an angle of 25° – 30° with the direction of the shank and their width increases in the direction of the fluke. It appears that their position is then parallel to the outer edges of the fluke, thus obtaining strong corners which, when rounded off, cannot cause damage and do not have any catching possibilities for wires.

A so-called "frame" construction is known with the "Eel" anchor, wherein the upper and lower side of the frame run parallel to the flukes and serve for toppling the anchor, so that the tips of the flukes bite into the ground. However, in the invention the upper and lower side of the frame, the so-called trim plates, make an angle of 18° with the flukes, thus attaining that with an anchor whose fluke makes a maximal angle of 32° with the shank, the upper trim plate will then be at an angle of 50° to the centreline of the shank and the lower trim plate at an angle of 14° to the shank centreline.

It is known that a fluke angle of 32° is the optimal angle to embed an anchor in hard soil, such as sand, clay, loam, while an angle of 50° is the optimal fluke angle for softer soil types, such as peat and mud. Certain anchors, such as "Stayright" and "Offdrill" can adapt said fluke angle to the soil type by means of a wedge.

Because the surface of the trim plate in an anchor according to the invention is only 22% smaller than that of a fluke, we may speak of an anchor having 4 flukes, of which the ideal fluke angle is present for any type of anchor soil.

Also in hard soil the trim plates function well because the topsoil is mostly softer and slightly looser than the soil which the flukes have in front of them. A larger angle of the upper trim plate in that case is therefore certainly no impediment, while the lower trim plate, at an angle of 14°, will very easily be capable of digging. Also the upper trim plate, at 50°, will limit the digging-in if the anchor arrives in clay soil. There is then produced a slight accumulation of clay against the trim plate, preventing excessive digging-in, which might result in problems during breaking-out.

The flukes may be wide because at the ends they have support from the stabilizing plates which form a "frame" with the trim plates.

Because of the wide flukes, a large quantity of soil is affected so that a high holding force is obtained.

Starting from the theory of Prandtl on occurring planes of shear due to strip load, it may be established that large holes in the flukes will cause no, or hardly any loss of holding force. The holes may occupy a surface area of 15–30% of the fluke surface area.

The advantages of large holes in the flukes are inter alia:

1. In sand and other well water-permeable soil types the water in front of the flukes will easily flow through the hole in the fluke. The soil pressure is grain pressure + water pressure. If the water pressure is reduced, this will thus result in a higher grain pressure. The shear resistance is exclusively provided by the grain structure and therefore by the grain pressure.

Concluding, a loaded anchor with holes in the flukes will attain, in sand, sooner an equilibrium than a similar anchor without holes.

2. Owing to the recessed holes the adherence, in soil having a high cohesion, to the large flukes will be less, so that the anchor will go deeper before the clod forming tendency occurs. A quicker and safer holding force will be the result.

3. In ground having a low cohesion (mud and peat) the anchor with holes in the flukes will have no chance, with the flukes directed obliquely upwards, to "drag" if during the dropping, it has arrived in that position, for there cannot be formed an accumulation of mud before the flukes, thus preventing the anchor from pivoting in the proper position; on the contrary, the loose ground can escape and the lower trim plate ensures a rapid pivoting in the proper position.

4. The holes in the flukes cause a particularly low break-out force because:

a. the cohesion on and underneath the flukes is less;
b. the ground falls away through the holes in the flukes;
c. the fluke angle may be larger because less vaulting is produced. Due to the larger fluke angle the fluke is more vertical, so that the breaking out is easier than in case of a more horizontal position of the fluke.

5. The holes in the flukes reduce the total anchor weight by about 5% and as a result increase the efficiency (holding force:weight) proportionally.

Figure 2:
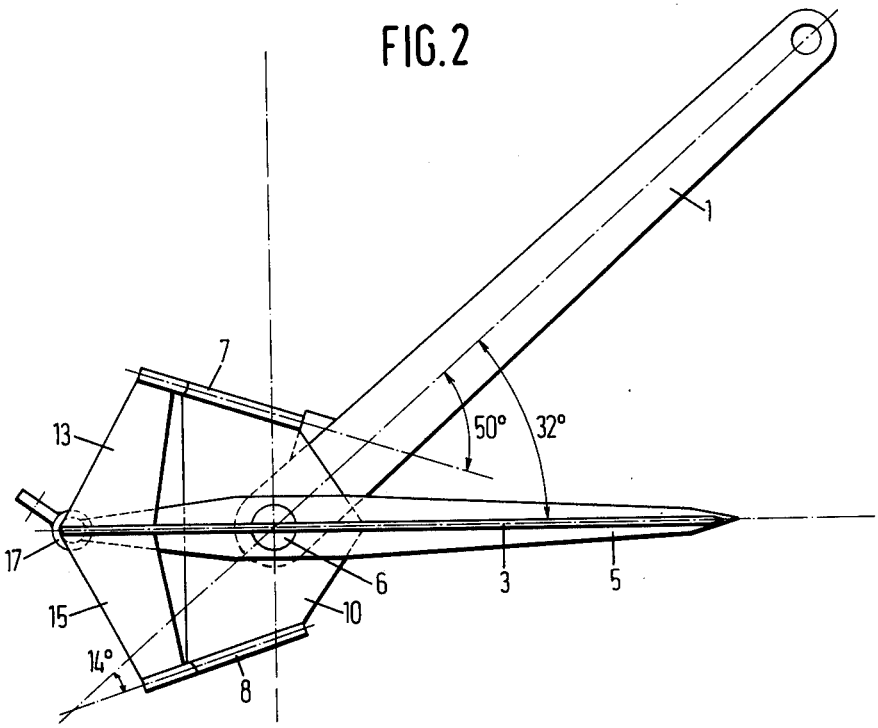
Figure 3:
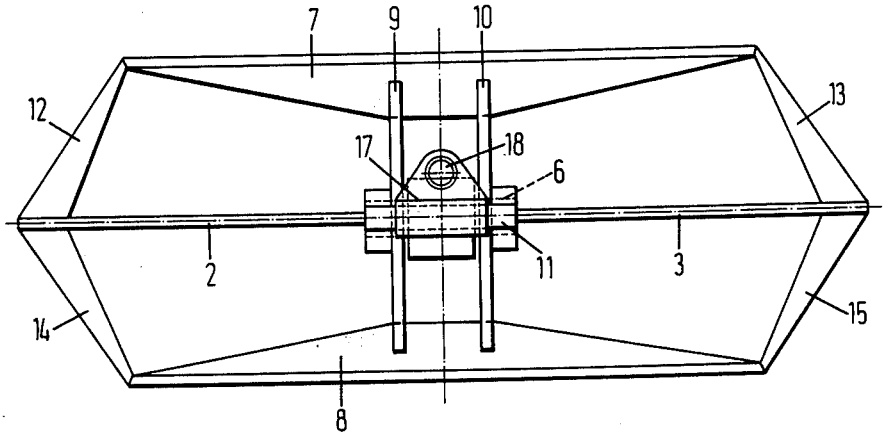

One embodiment of the invention will now be described, by way of example, with reference to the accompanying drawings, wherein:

FIG. 1 is a top view of the anchor;
FIG. 2 is a side view and
FIG. 3 is a back view.

The anchor includes a shank 1 and two substantially triangular flukes 2, 3 of steel plate which are arranged on opposite sides of an axis of symmetry as together to form a delta shape. The flukes, at their facing sides, are reinforced by ribs 4, 5. A pivot pin 6 inserted through the shank is mounted in bores of the ribs 4, 5 whereby the shank is pivotable in a plane containing the axis of symmetry of the flukes. On either side of said pivot pin 6 there are disposed trim plates or head faces 7, 8 which, by means of support plates 9, 10 disposed between the ribs 4, 5 and the shank 1, are connected to the flukes. Said trim plates 7, 8 converge in the pull direction of the anchor at an angle of 15° – 20° to the flukes.

In a preferred embodiment the width of the trim plates 7, 8 is equal to 75–85% of the total fluke width of the anchor, while the area of each trim plate corresponds with 70–85% of a fluke.

The rear ends of the flukes 2, 3 are connected by a round rod 11. A pennant wire for lifting the anchor can be simply attached pivotally on said rod, e.g. by a sleeve 17 having an eye 18 rotatable about said rod.

Between the ends of the trim plate 7 and the outer edges of the flukes 2, 3, there are welded stabilizing plates 12, 13.

In the same manner stabilizing plates 14, 15 are welded between the ends of the trim plate 8 and the outer edges of the flukes (see FIG. 3). Since the trim plates are narrower than the flukes, said stabilizing plates converge towards each other, enclosing an angle of 55° – 65° with the plane of the flukes.

Furthermore the stabilizing plates 12–15 enclose an angle of 25° – 30° with the pivot plane of the shank.

FIGS. 1 and 2 show that the stabilizing plates are present on the side of the pivot pin 6 remote from the shank, so that a better stability of the anchor is obtained.

According to FIG. 1 fluke 2 has a recess in the extension of the pivot pin 6 which, in the operating position, is covered by a plate 16 welded onto the fluke. For detaching the shank 1, the plate 16 is removed, whereafter the pin 6 can be axially slid out of the bore of shank 1, which provides a very simple method of demounting the shank of a heavy anchor.

In flukes 2, 3 there are recessed triangular holes 19, 20 respectively.

I claim:

1. An anchor in particular for anchoring special purpose vessels, dredgers, off-shore drilling platforms and the like, said anchor having two flukes arranged on both sides of an axis of symmetry so as together to form a delta shape, a shank mounted between said flukes for pivoting movement in a plane containing said axis of symmetry, and trim plates or head faces disposed on either side of the flukes, the width of said trim plates being less than the total width of the flukes, characterized in that the outer ends of both trim plates are connected to the outer edges of the flukes by means of stabilizing plates which enclose an acute angle both with the plane of the flukes and with the pivot plane of said shank, the width of the stabilizing plates increasing toward the flukes.

2. An anchor as in claim 1 wherein the width of the trim plates is equal to 75 – 85% of the total fluke width and the surface area of a trim plate is equal to 70 – 85% of the surface area of a fluke.

3. An anchor as in claim 1 wherein the flukes are provided with recesses occupying a surface area of 15 – 30% of the fluke surface area.

4. An anchor as in claim 1 wherein the stabilizing plates enclose an angle of 55° – 65° with the plane of the flukes and enclose an angle of 25° – 30° with said axis of symmetry of the flukes.

5. An anchor as in claim 4 wherein the width of the trim plates is equal to 75 – 85% of the total fluke width and the surface area of a trim plate is equal to 70 – 85% of the surface area of a fluke.

6. An anchor as in claim 4 wherein the flukes are provided with recesses occupying a surface area of 15 – 30% of the fluke surface area.

7. An anchor in particular for anchoring special purpose vessels, dredgers, off-shore drilling platforms and the like, said anchor having two flukes arranged on both sides of an axis of symmetry so as together to form a delta shape, a shank mounted between said flukes for pivoting movement in a plane containing said axis of symmetry, and trim plates or head faces disposed on either side of the flukes, the width of said trim plates being less than the total width of the flukes, characterized in that the outer ends of both trim plates are connected to the outer edges of the flukes by means of stabilizing plates which increase in width in the direction toward the fluke and which enclose an angle of 55° – 65° with the plane of the flukes and an angle of 25° – 30° with the pivot plane of said shank.

8. An anchor as in claim 7 wherein the width of the trim plates is equal to 75 – 85% of the total fluke width and the surface area of a trim plate is equal to 70 – 85% of the surface area of a fluke.

9. An anchor as in claim 7 wherein the flukes are provided with recesses occupying a surface area of 15 – 30% of the fluke surface area.

10. An anchor in particular for anchoring special purpose vessels, dredgers, off-shore drilling platforms and the like, said anchor having two flukes arranged on both sides of an axis of symmetry so as together to form a delta shape, a shank mounted between said flukes for pivoting movement in a plane containing said axis of symmetry, and trim plates or head faces disposed on either side of the flukes, the width of said trim plates being less than the total width of the flukes, characterized in that the outer ends of both trim plates are connected to the outer edges of the flukes by means of stabilizing plates which enclose an acute angle both with the plane of the flukes, and with the pivot plane of said shank, the width of the stabilizing plates increasing toward the flukes the width of the trim plates being equal to 75 – 85% of the total fluke width and the surface area of a trim plate being equal to 70 – 85% of the surface area of a fluke, the flukes being provided with recesses occupying a surface area of 15 – 30% of the fluke surface area.

11. An anchor as in claim 10 wherein the stabilizing plates enclose an angle of 55° – 65° with the plane of the flukes and enclose an angle of 25° – 30° with said axis of symmetry of the flukes.

12. An anchor as in claim 11 wherein the rear ends of the flukes are connected by a round rod having a rotatable sleeve thereon, said sleeve having a lifting eye.

13. An anchor as in claim 10 wherein the rear ends of the flukes are connected by a round rod having a rotatable sleeve thereon, said sleeve having a lifting eye.

* * * * *